US007472555B2

(12) United States Patent
Kirby et al.

(10) Patent No.: US 7,472,555 B2
(45) Date of Patent: Jan. 6, 2009

(54) VACUUM INSULATED REFRIGERATOR CABINET AND METHOD FOR ASSESSING THERMAL CONDUCTIVITY THEREOF

(75) Inventors: David Kirby, St. Joseph, MI (US); Luigi Martinella, Ghiffa (IT); Giorgio Giudici, Lonate Pozzolo (IT)

(73) Assignee: Whirlpool Corporation, Benton Harbor, MI (US)

( * ) Notice: Subject to any disclaimer, the term of this patent is extended or adjusted under 35 U.S.C. 154(b) by 625 days.

(21) Appl. No.: 10/519,438

(22) PCT Filed: Jun. 27, 2003

(86) PCT No.: PCT/EP03/06864

§ 371 (c)(1),
(2), (4) Date: Dec. 29, 2004

(87) PCT Pub. No.: WO2004/003445

PCT Pub. Date: Jan. 8, 2004

(65) Prior Publication Data

US 2005/0223721 A1 Oct. 13, 2005

(30) Foreign Application Priority Data

Jul. 1, 2002 (EP) ..... 02014062

(51) Int. Cl.
*F25D 23/00* (2006.01)

(52) U.S. Cl. ..... 62/132; 62/DIG. 13; 220/592.09

(58) Field of Classification Search ..... 62/132, 62/126, 45.1, DIG. 13; 220/592.07, 641, 220/592.09; 164/102, 138; 264/102, 138
See application file for complete search history.

(56) References Cited

U.S. PATENT DOCUMENTS

| | | | | | |
|---|---|---|---|---|---|
| 5,038,304 | A | * | 8/1991 | Bonne | 702/99 |
| 5,361,598 | A | * | 11/1994 | Roseen | 62/229 |
| 5,622,430 | A | * | 4/1997 | Pletka et al. | 374/45 |
| 5,934,085 | A | * | 8/1999 | Suzuki et al. | 62/98 |

FOREIGN PATENT DOCUMENTS

| | | | |
|---|---|---|---|
| DE | 10006878 | A1 | 9/2001 |
| EP | 0633420 | A2 | 1/1995 |
| FR | 1454539 | | 2/1966 |
| JP | 59015845 | A * | 1/1984 |

* cited by examiner

*Primary Examiner*—Chen-Wen Jiang
(74) *Attorney, Agent, or Firm*—Kirk Goodwin; Michael D. Lafrenz

(57) ABSTRACT

A vacuum insulated refrigerator cabinet comprises an evacuation system for evacuating an insulation space of the cabinet when pressure inside such space is higher than a predetermined value. The cabinet presents sensor means comprising a temperature sensor and a heater both located within the insulation space and a control system for activating the heater according to a predetermined heating cycle and for receiving a signal from the temperature sensor, such control system being able to provide the evacuation system with a signal related to the insulation level within the insulation space.

7 Claims, 1 Drawing Sheet

VACUUM INSULATED REFRIGERATOR CABINET AND METHOD FOR ASSESSING THERMAL CONDUCTIVITY THEREOF

CROSS-REFERENCE TO RELATED APPLICATIONS

The present application is a National stage application of PCT/EP03/06864, filed Jun. 27, 2003.

1. Field of the Invention

The present invention relates to a vacuum insulated refrigerator cabinet comprising an evacuation system for evacuating an insulation space of the cabinet when pressure inside such space is higher than a predetermined value.

With the term "refrigerator" we mean every kind of domestic appliance in which the inside temperature is lower than room temperature, i.e. domestic refrigerators, vertical freezers, chest freezer or the like.

2. Discussion of the Prior Art

A vacuum insulated cabinet (VIC) for refrigeration can be made by building a refrigeration cabinet that has a hermetically sealed insulation space and filling that space with a porous material in order to support the walls against atmospheric pressure upon evacuation of the insulation space. A pump system may be needed to intermittently re-evacuate this insulation space due to the intrusion of air and water vapour by permeation. A solution of providing a refrigerator with a vacuum pump running almost continuously is shown in EP-A-587546, and it does increase too much the overall energy consumption of the refrigerator. It is advantageous for energy consumption to re-evacuate only when actually needed. Therefore there is in the art the need of a simple and inexpensive insulation measurement system that would be applicable to operate a refrigerator cabinet vacuum pump or similar evacuation system only when actually needed.

The present invention provides a vacuum insulated refrigerator cabinet having such insulation measurement system, according to the appended claims.

According to the invention the measurement system is a system that measures the insulating value of the VIC insulation. A non-equilibrium measuring approach is taken that requires only one temperature sensor. This sensor is buried in the evacuated insulation material, preferably in a central position thereof with reference to the thickness of the insulation space. At a central position within the insulation space, the disturbances from transients in external surface temperature are minimised. However, the sensor device may be placed in any portion of the vacuum space, but with likely complications due to the transients in external surface temperature. It is also possible to place the sensor device on an external portion of evacuated insulation that is connected by a conduit to the main vacuum insulation chamber, mainly in order to facilitate the mounting of the sensor device. In immediate proximity to the sensor is a heat source that can be pulsed. The thermal pulse is controlled to a small, precise amount of thermal energy. The insulation and the temperature sensor, in the immediate area of the thermal pulse, will show a temporary increase in temperature. The effective thermal conductivity, heat capacity and density of the surroundings of the thermal pulse control the decay of the increase in temperature. Heat capacity and density are expected to remain constant over the life of the refrigerator, but the thermal conductivity will increase due to the deterioration of vacuum level in the insulation. An analysis of the decay will produce a measure of thermal conductivity and allow a criterion for pumping to be applied. Due to the fact that this device is centrally located in the insulation, relieves the problems of outside temperature variations. At any rate it is possible to apply the device to the external wall of the insulation space and protect it with an insulating pad. After calibration, this device may just have to record one temperature at a specified time after the application of the temperature pulse for use as the pumping criterion.

BRIEF DESCRIPTION OF THE DRAWINGS

The invention will now be explained in greater detail with reference to drawings, which show.

DETAILED DESCRIPTION OF THE PREFERRED EMBODIMENT

Figure 1:
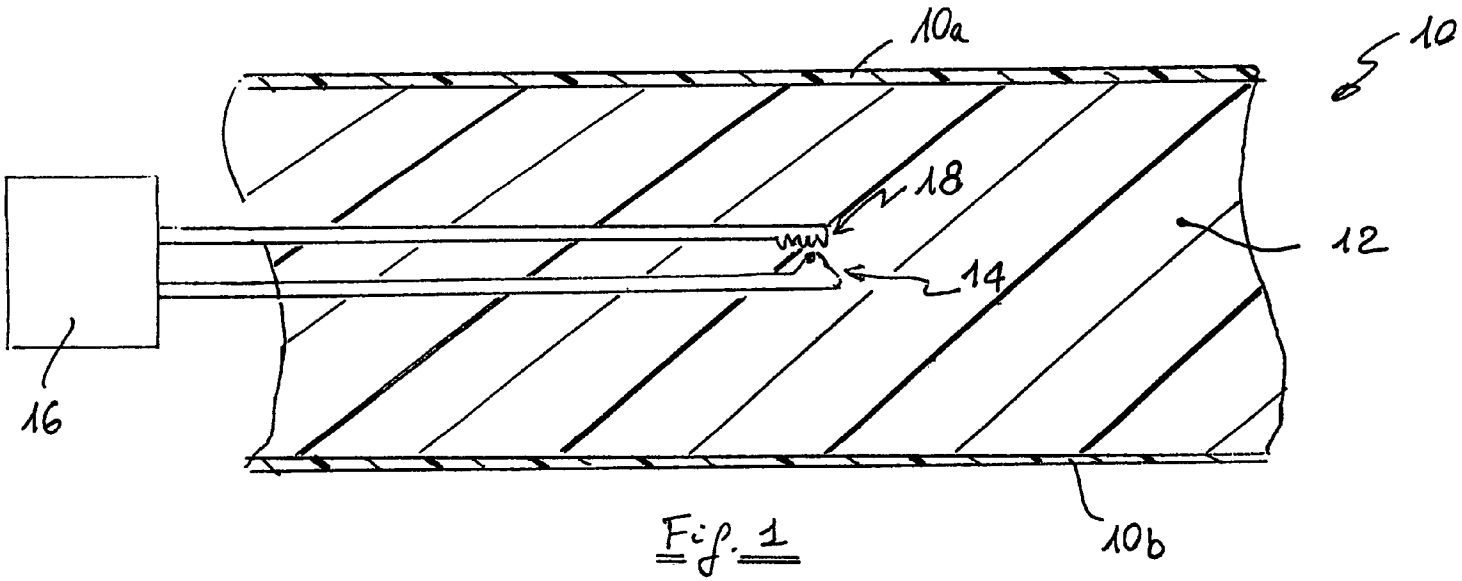
FIG. 1 is a schematic cross-view of a wall of a vacuum insulated cabinet according to the invention.

With reference to the figures, a refrigerator cabinet comprises an insulated double wall 10 comprising two relatively gas impervious walls 10*a* (liner) and 10*b* (wrapper) filled with an evacuated porous insulation material 12. Both liner 10*a* and wrapper 10*b* may be of polymeric material. The insulation material 12 can be an inorganic powder such as silica and alumina, inorganic and organic fibers, an injection foamed object of open-cell or semi-open-cell structure such as polyurethane foam, or a open celled polystyrene foam that is extruded as a board and assembled into the cabinet. The insulation material 12 is connected to a known evacuation system (not shown) that can be a physical adsorption stage (or more stages in series) or a mechanical vacuum pump or a combination thereof.

According to the invention, inside the insulation material 12 of the double wall 10 it is buried a temperature probe 14 connected to a control unit 16. In the proximity of the temperature probe 14, at a close distance therefrom, it is buried an electric heater 18 also connected to the control unit 16. The control unit 16 is linked to the system (not shown) for evacuating the insulation material 12.

Figure 2:
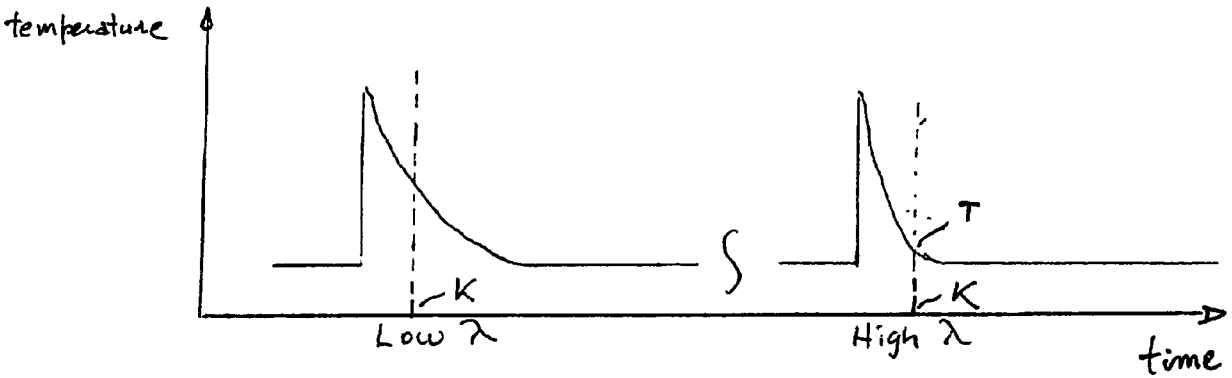
FIG. 2 is a schematic diagram showing the relationship between the temperature measured in the proximity of the heat source and the time, in two different conditions of thermal conductivity.

According to a second embodiment of the invention, it is possible to use a heated wire as the thermal source and then measure the temperature decay in the wire by using the same wire as a resistance thermometer. In order to assess the performances of the insulation material, the control unit 16 switches on the electric heater 18 for a short period, typically of 1-10 s, and with switching interval preferably comprised between 1 and 30 days. At the same time, the temperature probe 14 measures the sudden increase of temperature around the heater 18, and the following decay when the heater is switched off. The heater is switched on and off according to a predetermined pulse pattern, whose time interval between pulses may vary broadly according to the insulation material 12, its width, the material of the liner 10*a* and wrapper 10*b* and thickness thereof. The decay of temperature (FIG. 2) is highly influenced by the pressure inside the VIC insulation, and therefore by actual thermal conductivity of insulation material 12. In the left portion of FIG. 2 it is shown an example of temperature decay when the thermal conductivity $\lambda$ is low (low pressure), while in the right portion of FIG. 2 it is shown an example of temperature decay when the thermal conductivity $\lambda$ has increased due to an increase of pressure inside the material 12, for instance after some days from the last intervention of the vacuum pump. If at a predetermined time K the temperature is lower than a threshold value T, then it is time for the control unit 16 to switch on the vacuum pump in order to re-establish the correct performances of the refrigerator. Of course the control unit 16 may also assess when for a predetermined temperature, the time for reaching such temperature is shorter than a threshold value. From the above description it is clear that it is not necessary to detect how the temperature measured by the sensor 14 changes with time, since it is needed to record one temperature only at a predetermined time after the temperature pulse.

The general energy conservation equation for the heat diffusion through a solid medium, in the case of the sensor system according to the present invention, can be approximated as one-dimensional due to the geometric characteristic of domestic refrigerator walls, where one of the dimensions (thickness) is usually much smaller then the other two (height and width). Also, although the thermal conductivity k varies with time, it is not a function of position (spatially invariable), that reduces the equation for heat diffusion to:

$$K \times \frac{d^2 T}{dx^2} + q'' = p \times c \times \frac{dT}{dt} \quad (1)$$

$$k \times \frac{\partial^2 T}{\partial x^2} + q'' = \rho \times c \times \frac{\partial T}{\partial t} \quad (1)$$

where T is the temperature, t is time, x is the distance measured across the vacuum wall thickness, k is the thermal conductivity, q" is the energy generated inside the wall, p is density, and c is the specific heat of the vacuum insulation.

The equation (1) may have several different solutions, depending on the boundary and initial conditions attributed to the dependent variable T, the expression for q", etc., In general, the form of these solutions can be very complex, and for some cases we have to rely on numerical techniques in order to seek the solution for the temperature variation along the time. From computational simulation of the temperature evolution as a function of time it is immediately evident that the largest the thermal conductivity "k", the steepest the temperature decay.

Due to being located preferably in the centre of the refrigerator insulated wall and because of the thermal capacitance of the vacuum insulation transient, short term changes in the surrounding conditions will be smoothed out and won't affect the "temperature versus time" measured by the temperature probe.

Due to this, the measuring device is practically insensitive to:

door opening, internal temperature switching due to compressor cycling.

Both external (ambient variations) as internal temperature changes (different thermostat set-up) may produce small changes in the probe reading, at some pre-determined time after the pulse heater is switched on. Therefore it is preferred to keep track of internal and external temperatures and feed this information into the logic to control the vacuum pump switching on/off, along with the built-in probe reading.

In view of the above, it is preferred to use thermistors for temperature measurement with accuracy better than 0.2° C. Moreover, it is also preferred to keep track of ambient and internal temperatures, and this information used to "calibrate" the temperature measured according to the present invention.

The invention claimed is:

1. A vacuum insulated refrigerator cabinet comprising an evacuation system for evacuating an insulation space of the cabinet when pressure inside such space is higher than a predetermined value, said system including sensor means comprising a temperature sensor and a heater both located in a portion of the evacuation system and a control system for activating the heater according to a predetermined heating cycle and for receiving a signal from the temperature sensor, such control system being able to provide the evacuation system with a signal related to the insulation level within the insulation space.

2. A vacuum insulated refrigerator cabinet according to claim 1, wherein such temperature sensor and such heater are both located within the insulation space.

3. A vacuum insulated refrigerator cabinet according to claim 2, having such temperature sensor and such heater are the same wire used either for heating purpose or for temperature measurement.

4. A vacuum insulated refrigerator cabinet according to claim 3, having such temperature sensor and such heater are placed centrally in the insulation space.

5. A vacuum insulated refrigerator cabinet according to claim 1, wherein the heating cycle of such heater comprises a series of heating pulses.

6. Method for assessing the thermal conductivity of an insulation space of a vacuum insulated refrigerator cabinet, wherein such method comprises the steps of providing a predetermined amount of heat inside the insulation space, and measuring temperature in the proximity of the zone where heat has been provided in order to have an indication on how temperature decreases in such zone, the faster being the decrease vs. time, the higher being thermal conductivity of the insulation space.

7. Method according to claim 6, wherein heat is provided inside the insulation space in a series of pulses.

* * * * *